United States Patent [19]

Matejec et al.

[11] 4,201,395

[45] May 6, 1980

[54] ROLLER SKATE SHOE TOE GUARD

[75] Inventors: John K. Matejec, Tulsa; Jerry D. Lowry, Broken Arrow; Gene R. N. Fulbright, Tulsa, all of Okla.

[73] Assignee: Vanguard Manufacturing, Inc., Tulsa, Okla.

[21] Appl. No.: 949,968

[22] Filed: Oct. 10, 1978

[51] Int. Cl.[2] ..... A63C 17/26

[52] U.S. Cl. ..... 280/11.37 M

[58] Field of Search ..... 280/11.37 M, 11.37 E, 280/11.37 R, 11.2, 11.19, 11.12, 11.28, 11.27, 11.26, 11.25, 11.23, 11.22, 11.21, 11.1 R

[56] References Cited

U.S. PATENT DOCUMENTS

| | | | |
|---|---|---|---|
| 1,351,509 | 8/1920 | Ess | 280/11.37 M |
| 1,806,975 | 5/1931 | Johnson | 280/11.37 M |
| 1,832,866 | 11/1931 | Johnson | 280/11.37 M |
| 2,029,787 | 2/1936 | Ohler | 280/11.37 M |
| 2,037,964 | 4/1936 | Chochkoff | 280/11.37 M X |
| 2,836,908 | 6/1958 | Altinger | 280/11.37 M |
| 2,864,180 | 12/1958 | Montgomery | 36/72 R |
| 3,035,846 | 5/1962 | Asad | 280/11.2 |
| 3,104,887 | 9/1963 | Rice et al. | 280/11.28 X |
| 3,806,145 | 4/1974 | Czeiszperger | 280/11.37 M |
| 3,968,973 | 7/1976 | McCormack | 280/11.2 |

*Primary Examiner*—Joseph F. Peters, Jr.
*Assistant Examiner*—Milton L. Smith
*Attorney, Agent, or Firm*—Head & Johnson

[57] ABSTRACT

A toe guard for use on a roller skate shoe having an extending toe stop adjacent the shoe toe, the guard being an elongated flexible member having a large diameter opening at one end of a dimension to receive the toe stop and of length to extend over the shoe toe and having small openings in the other end which receive shoe laces for holding the toe guard in position.

8 Claims, 6 Drawing Figures

ROLLER SKATE SHOE TOE GUARD

BACKGROUND AND OBJECTS OF THE INVENTION

Roller skating is a very popular activity in the United States and many parts of the world and is growing in interest. When roller skates were first introduced to the public, they commonly were the type that clamped on to the soles of the shoes of the users. In more recent years, roller skates are manufactured as an integral component of shoes, normally by attaching the platform of a roller skate directly to the heel and sole of the shoe. Since roller skates are designed with wheels having bearings to afford minimum rotational resistance, the skater is always faced with the problem of stopping rapidly. A means usually employed by skaters is to drag the toe of one foot. For this reason, toe stops are commonly a part of roller skates. The toe stops are typically cylindrical members, usually frusto-conically shaped with the small diameter end affixed to the forward lower end of the skate shoe. The user, to slow down or stop, tilts one foot forward so that the toe stop engages the skating surface to provide friction and therefore braking action. However, many skaters prefer to drag the foot further behind them when stopping, which tends to cause the toe of the shoe to engage the skating surface and thereby results in rapid wearing of the shoe toe. This is particularly true amoung younger skaters.

Skating rinks which rent skate shoes at nominal expense to skating patrons particularly find that replacement costs of shoes having the toes worn from being dragged on the skating surface is a large expense item. In addition, individual owners of skate shoes who prefer to drag the toe of one shoe during braking action find that replacing skating shoes because the toe is worn is a big expense to their skating activity.

The present invention provides a toe guard for use on roller skates to protect the toe of the skate shoe. Particularly, an object of the present invention is to provide a toe guard for use on roller skate shoes which have an extended toe stop adjacent the shoe toe, the toe guard being in the form of an elongated flexible member having a large diameter opening at one end of a dimension to receive the toe stop of the roller skate shoe and having small openings at the other end which receive the shoe lace so that the toe guard extends over the toe of the shoe to protect it against wear.

Still more particularly, an object of the invention is to provide a toe guard as described configured in a way to insure that the toe guard will remain in proper position over the toe of the shoe and will not likely be displaced to one side or the other.

These objects, as well as other and more specific objects of the invention will be fulfilled in the following description and claims, taken in conjunction with the attached drawings.

SUMMARY OF THE INVENTION

A toe guard for use on a roller skate shoe having a lace and an extending toe stop adjacent the forward lower end of the shoe toe, the toe guard being in the form of an elongated flexible member, such as of resilient plastic, having a large diameter opening at one end of a diameter to snugly receive the toe stop of the roller skate shoe. The length of the toe guard is sufficient so that it extends from the toe stop over the shoe toe. The other end of the toe guard has small diameter openings which receive the laces of the shoe. The toe guard is used by extending the large diameter opening over the toe stop, positioning the toe guard over the toe of the shoe, and attaching the other end with the laces of the shoe to hold the toe guard in place. In the preferred embodiment, the toe guard includes a recess in the area where it engages the skate shoe toe and includes integral positioning bosses extending from opposite sides of the member which, when in place on a shoe, extend to either side of the toe of a shoe to prevent the toe guard from being inadvertently displaced.

DETAILED DESCRIPTION

Figure 1:
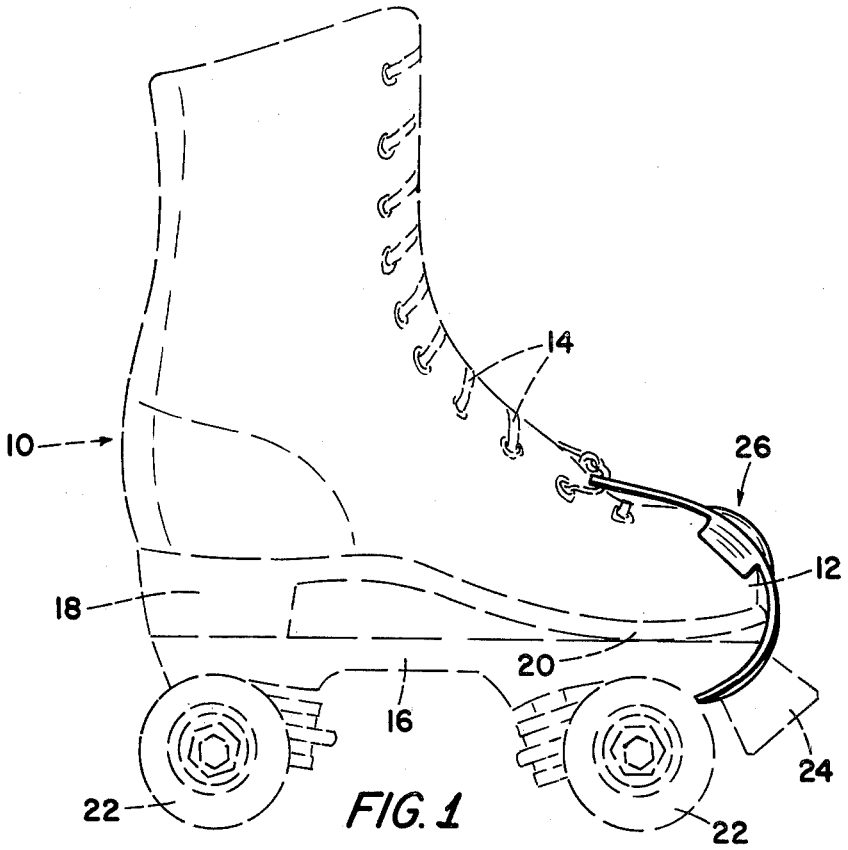
FIG. 1 is an elevational side view of a skate shoe shown in dotted outline and showing the toe guard of this invention as positioned on the skate shoe.
Figure 2:
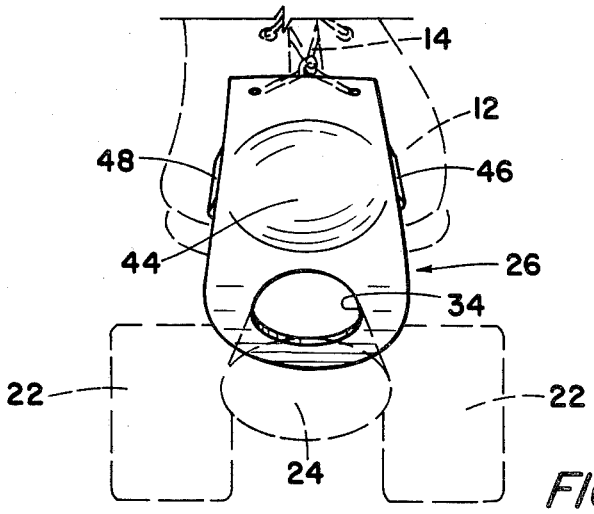
FIG. 2 is an elevational fragmentary front view of the skate shoe of FIG. 1 showing the toe guard of this invention in position on the skate shoe.

Referring to the drawings and first to FIGS. 1 and 2, a roller skate shoe is generally indicated by the numeral 10. The skate shoe includes a toe 12 and laces 14.

The roller skate shoe includes a platform 16 which is secured to the heel 18 and sole 20 of shoe 10. Supported by the platform are wheels 22 and affixed to the platform lower forward portion is a toe stop 24. The toe stop 24 is provided to form a braking means so that the user can pivot his foot forward so that the toe stop 24 engages the skating surface to drag the toe stop on the surface when he desires to stop or to slow down. The toe stop 24 is typically of hard material such as hard rubber or plastic and is usually molded in the shape of a frusto-conical member, larger at the outer end which engages the floor surface, and smaller at the end where it is affixed to the shoe platform 16.

All of the elements described to this point are those which are found on a typical roller skate shoe. The invention is directed toward a guard for use on the shoe 10 as heretofore described and to protect the toe 12 of the shoe when the user drags the toe, either intentionally or inadvertently, for stopping action.

Figure 3:
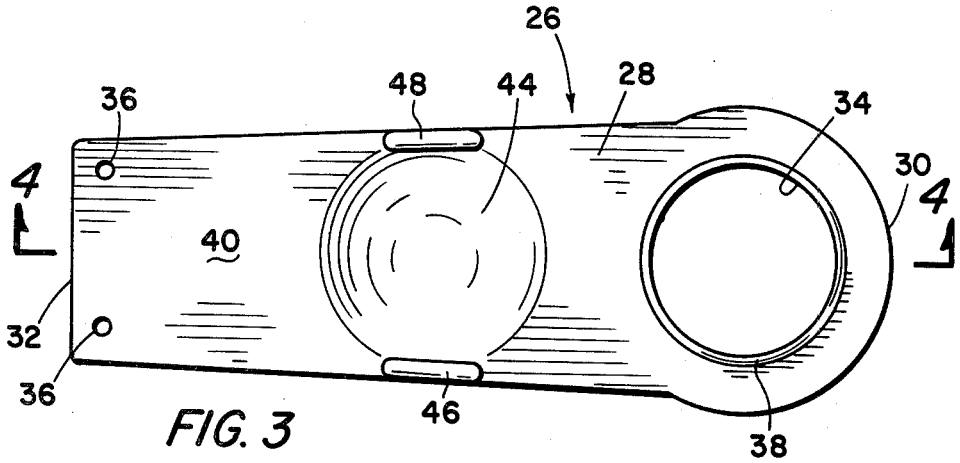
FIG. 3 is a plan view of the toe guard of this invention showing the toe guard in its extended, nonflexed form.
Figure 4:
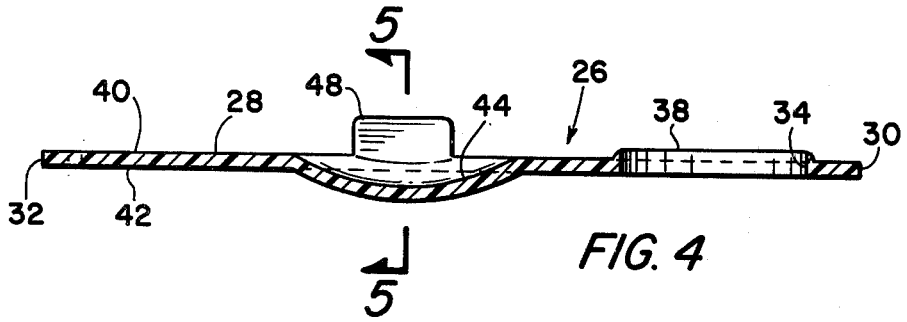
FIG. 4 is a cross-sectional view taken along the line 4—4 of FIG. 3.
Figure 6:
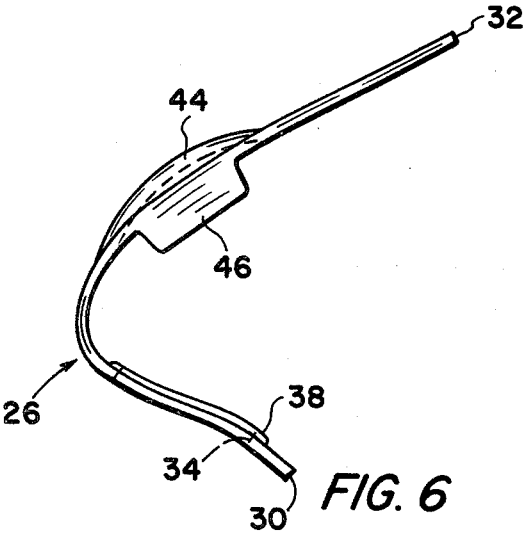
FIG. 6 is a side view of the toe guard shown in the flexed position it takes when the toe guard is affixed to a skate shoe.
Figure 5:
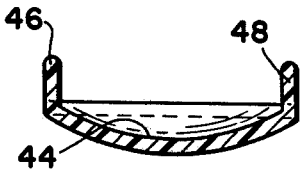
FIG. 5 is a cross-sectional view taken along the line 5—5 of FIG. 4 and showing the configuration of the toe guard at the point where it engages the toe of the skate shoe and providing means of preventing the toe guard from slipping off of the toe of the shoe.

Referring to FIGS. 3 and 4, the toe guard is best illustrated. The toe guard is generally indicated by the numeral 26 and is in the form of an elongated flexible member 28 which may be said to be generally rectangular in construction, but, in the illustrated arrangement, tapers from a first end 30 towards a second end 32.

At the first end 30 there is provided a large diameter opening 34 of a dimension to snugly receive the toe stop 24. In the preferred arrangement, the diameter of opening 34 is slightly less than the maximum diameter of toe stop 24, and the toe guard is positioned on a shoe by expanding the opening 34 to slide over the toe stop 24 to the position as shown in FIGS. 1 and 2.

Adjacent the second end 32 of member 28 are two small diameter openings 36 which receive the lace 14 of a skate shoe 10 as shown in FIGS. 1 and 2.

The member 28 is preferably formed of generally flat flexible material, such as plastic or leather. A resilient material is preferred since it permits the large diameter opening 34 to be expanded over the toe stop to hold the toe guard in place. The member 28 is preferably of a flat material about 2 millimeters in thickness, although thicker or thinner material may be employed according to the nature of the material utilized.

The member 28 is preferably of substantially uniform thickness, but a preferred arrangement includes an integral circular reinforcing rib 38 around opening 34. This reinforcing rib 38 adds to the lift of the toe guard and ensures that the material around opening 34 will not easily tear out as it is positioned over a toe stop.

In order for the toe guard to work most advantageously, it is sometimes important that means be provided to prevent it from inadvertently slipping off the toe of the shoe on which it is positioned. To improve the performance of the toe guard, two innovative features are illustrated. The toe guard includes, as shown in FIG. 4, an inner surface 40 and an outer surface 42. Integrally formed in the toe guard is a circular recess 44 which is concave on the inner surface 40 and convex on the outer surface 42. The circular recess 44 is positioned approximately midway between the large diameter opening 34 and small diameter openings 36 and in the area of the toe guard which extends over and is contiguous with the shoe toe. The recess thereby helps to receive the toe of the shoe and retain the toe stop in position.

As a further means of retaining the toe guard in proper position over the toe of the shoe of the user, integrally extending from the inner surface 40 are positioning bosses 46 and 48. The positioning bosses are at the outer edges of the member 28 and in the area to be received by the toe of the shoe on which the toe guard is positioned. When the positioning bosses 46 and 48 are utilized in conjunction with recess 44, then the positioning bosses are, as illustrated, integrally formed to either side of the recess 44.

Bosses 46 and 48 serve to prevent the toe guard from inadvertently slipping to one side or other of the toe of the shoe on which the guard is positioned. It can further be seen that the recess 44 may be used with or without the positioning bosses 46 and 48, and correspondingly, positioning bosses 46 and 48 may be used, with or without recess 44. The combination of the recess and positioning bosses together affords additional assurance that the toe guard will always remain in position on the shoe.

The toe guard as described provides an inexpensive means of protecting a roller skate shoe, either those of an individual owner, or those owned by a roller skating rink. The toe guards are easily replaced in a matter of minutes merely by removing the laces from openings 36 and expanding large diameter opening 34 off the toe stop. New toe guards can as expeditiously be placed on shoes by the user. Thus, an inexpensive device protects relatively expensive skate shoes. Further, when the toe guards are formed of resilient plastic material, they provide a surface having high frictional characteristics and thereby improve the braking action of the user when the toe guards are positioned against the skating surface by the user.

While the invention has been described with a great deal of particularity, many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A toe guard for use on a roller skate shoe having a lace and an extending toe stop adjacent the shoe toe, the toe guard comprising:

an elongated flexible member having a large diameter opening at one end of a dimension to snugly receive a toe stop of a roller skate shoe, and of length to extend from the toe stop over the shoe toe, and having adjacent the other end opposed small diameter openings for receiving the lace of a roller skate shoe.

2. A toe guard according to claim 1 wherein the member is formed of resilient plastic.

3. A toe guard according to claim 1 in which the member is generally rectangular and defined at the end having said toe stop receiving opening by a semi-circular configuration, the diameter of said configurations being slightly greater than the rectangular width.

4. A toe guard according to claim 1 wherein the member is of substantially uniform thickness, and including an integral circular reinforcing rib of increased thickness surrounding said large diameter toe stop opening.

5. A toe guard according to claim 1 wherein the member includes an inner surface and an outer surface, and including an integral circular toe recess, the inner surface being concave at the recess and the outer surface being convex.

6. A toe guard according to claim 1 wherein the member includes an inner and an outer surface and including opposed, integral positioning bosses at opposed edges of the member intermediate the member ends, the bosses extending from the member inner surface and serving, when the member is attached to a skate shoe, to extend to either side of the shoe toe to maintain the member in proper position.

7. A toe guard for use on a roller skate shoe having laces, an extending toe stop adjacent the shoe toe, the toe guard comprising:

an elongated flexible member of general rectangular configuration having opposed ends and opposed sides and having an inner and outer surface, one end being defined by a semicircular configuration and having a large diameter opening therein coaxial with the semi-circular end, the opening being dimensioned to snugly receive a skating shoe toe stop, and having adjacent the other end opposed small diameter openings for receiving the lace of a roller skate shoe, and the member including an integral circular toe recess positioned intermediate the member ends and sides, the inner surface being concave and the outer surface convex at the recess, and the member including opposed integral positioning bosses at opposed edges of the member and at opposed sides of said toe recess, the bosses extending from the member inner surface, said toe recess and positioning bosses serving when the member is attached to a skate shoe, to maintain the member in proper position over the shoe toe.

8. A toe guard according to claim 7 wherein the member is formed of resilient plastic.

* * * * *